US008406645B2

(12) United States Patent
Okuno et al.

(10) Patent No.: US 8,406,645 B2
(45) Date of Patent: Mar. 26, 2013

(54) IMAGE FORMING APPARATUS AND IMAGE FORMING METHOD FOR ADJUSTING DEVELOPING BIAS

(75) Inventors: Yuusuke Okuno, Toyokawa (JP); Kentaro Katori, Nakano-ku (JP); Kanji Nakayama, Toyokawa (JP); Tomo Kitada, Toyokawa (JP); Toru Hayase, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 367 days.

(21) Appl. No.: 12/473,541

(22) Filed: May 28, 2009

(65) Prior Publication Data

US 2009/0304404 A1 Dec. 10, 2009

(30) Foreign Application Priority Data

Jun. 10, 2008 (JP) ..... 2008-151445

(51) Int. Cl.
*G03G 15/06* (2006.01)

(52) U.S. Cl. ..... 399/56; 399/53; 399/55

(58) Field of Classification Search ..... 399/44, 399/53–56

See application file for complete search history.

(56) References Cited

U.S. PATENT DOCUMENTS

| | | | | |
|---|---|---|---|---|
| 4,342,822 | A * | 8/1982 | Hosono et al. | 430/122.51 |
| 5,032,485 | A * | 7/1991 | Kanbe et al. | 430/120.1 |
| 5,044,310 | A * | 9/1991 | Kanbe et al. | 399/281 |
| 5,096,798 | A * | 3/1992 | Kanbe et al. | 430/122.8 |
| 5,365,318 | A * | 11/1994 | Hiraoka et al. | 399/44 |
| 7,058,334 | B2 * | 6/2006 | Do et al. | 399/98 |
| 7,853,161 | B2 * | 12/2010 | Hayase et al. | 399/55 |
| 2002/0009304 | A1 * | 1/2002 | Kin et al. | 399/55 |
| 2002/0131785 | A1 * | 9/2002 | Ito | 399/44 |
| 2008/0240759 | A1 * | 10/2008 | Kouno | 399/55 |
| 2009/0175636 | A1 * | 7/2009 | Hayase et al. | 399/43 |

FOREIGN PATENT DOCUMENTS

| | | |
|---|---|---|
| JP | 2000-122411 | 4/2000 |
| JP | 2001-075341 A | 3/2001 |
| JP | 2006-301479 A | 11/2006 |

OTHER PUBLICATIONS

Notification of Reasons for Refusal issued in corresponding Japanese Patent Application No. 2008-151445, mailed Jan. 19, 2010, and English translation thereof.

* cited by examiner

*Primary Examiner* — David Gray
*Assistant Examiner* — G. M. Hyder
(74) *Attorney, Agent, or Firm* — Buchanan Ingersoll & Rooney PC

(57) ABSTRACT

Developing bias is set as follows. An electric field intensity between a developing roller and a photoconductor is set to cause normally-charged toner to fly in an image area and not to cause the toner to fly in a background area. Thus, the normally-charged toner does not fly in the background area. The normally-charged toner caused to fly is therefore unlikely to flick low-charged toner and oppositely-charged toner. The low-charged toner and the oppositely-charged toner will not adhere to the background area and cause image fogging. Accordingly, an image forming apparatus can be provided to prevent the low-charged toner and the oppositely-charged toner from adhering to the background area of an electrostatic latent image on the photoconductor and to avoid the occurrence of image fogging in the background area on a printed material.

8 Claims, 13 Drawing Sheets

IMAGE FORMING APPARATUS AND IMAGE FORMING METHOD FOR ADJUSTING DEVELOPING BIAS

This application is based upon and claims the benefit of priority from the prior Japanese Patent Application No. 2008-151445 filed on Jun. 10, 2008, the entire contents of which are incorporated herein by reference.

TECHNICAL FIELD

The present invention relates to an image forming apparatus of a non-contact developing type using non-magnetic mono-component toner, and an image forming method. Particularly, the present invention relates to an image forming apparatus and method capable of adjusting a developing bias to prevent image fogging.

BACKGROUND ART

An image forming apparatus is arranged to form an electrostatic latent image on the surface of a photoconductor and giving toner to the electrostatic latent image for development. In an image forming apparatus 300 as shown in FIG. 1, a photoconductor 310 is charged by a charging device 320 and then the charged surface of the photoconductor 310 is partly exposed by an exposure device 330 to form an electrostatic latent image.

A concrete image forming method is described below. Firstly, the surface of the photoconductor 310 is uniformly charged by the charging device 320. Secondly, the exposure device 330 applies light corresponding to an image to the uniformly charged surface of the photoconductor 310. Thus, a potential of the light exposed portion is changed. Herein, in the surface of the photoconductor 310, a light exposed portion corresponds to an image area to which toner will be given and a light unexposed portion corresponds to a background area to which toner will not be given. In this way, the electrostatic latent image including the image area and the background area is formed on the photoconductor 310. Successively, the charged toner is given to the electrostatic latent image on the surface of the photoconductor 310 by a developing roller 340, thereby forming a visible image. The toner on the surface of the photoconductor 310 is then transferred to a paper by a transfer unit 350. The transferred toner is fixed to the paper by a fuser unit 360 to prevent peeling of the toner. After the transferring, toner remaining on the surface of the photoconductor 310 is collected by a cleaner 370 to a toner collecting container 371.

The non-contact developing type development is conducted by applying a developing bias to attract the toner from the developing roller 340 onto the electrostatic latent image on the photoconductor 310. Accordingly, it is important for ensuring the quality of a printed material to cause a needed amount of toner to exactly or faithfully adhere to the electrostatic latent image in order to output clear and appropriately dark printed images. It is also necessary to prevent toner from adhering to the background area.

In the case where this developing bias has an alternating current component, toner moves back and forth between the photoconductor 310 and the developing roller 340. This motion is shown in FIG. 2. Specifically, the toner is caused to fly from the developing roller 340 to the photoconductor 310 by a developing voltage and to fly back from the photoconductor 310 to the developing roller 340 by a collecting voltage. By repeating this series of steps, the toner finally adheres to the electrostatic latent image on the photoconductor 310 for development.

An example of the developing bias to be applied is shown in FIG. 3. A developing voltage "Vmin" and a collecting voltage "Vmax" have opposite signs and are applied alternately. Accordingly, the charged toner receives forces forward and backward alternately. According to those voltages, the toner is caused to fly between the photoconductor 310 and the developing roller 340.

Meanwhile, charging characteristics of toner will change due to friction and others. At an initial stage, toner has good charging characteristics and little variation in charging amount. In the image forming apparatus, at the initial stage, such toner with good charging characteristics is stored in the developing device. This toner has an appropriate charge quantity to be attracted onto the developing roller 340 (hereinafter, referred to as "normally-charged toner"). However, when the toner deteriorates, some particles of the toner would only have a low charge quantity (hereinafter, referred to as "low-charged toner"). This low-charged toner may adhere to the background area of the electrostatic latent image to which the toner actually should not adhere. This results in image fogging during printing, leading to degradation in the quality of a printed material.

Therefore, a method of preventing the image fogging resulting from the low-charged toner has been proposed. Patent Literature 1 discloses a developing device and an image forming apparatus arranged to adjust an absolute value $|Vmax-Vd|$ which is a difference between a peak voltage Vmax that forms an electric field in a direction that causes toner to fly toward a photoconductor and a potential Vd of the background area of the electrostatic latent image. This configuration adjusts the value $|Vmax-Vd|$ according to a decrease in toner charge quantity to prevent the image fogging. It is to be noted that the peak voltage Vmax disclosed in Patent Literature 1 corresponds to the developing voltage Vmin in FIG. 3 and the peak voltage Vmin in Patent Literature 1 corresponds to the collecting voltage Vmax in FIG. 3.

CITATION LIST

Patent Literature

Patent Literature 1: JP2006-301479A

SUMMARY OF THE INVENTION

Technical Problem

However, as deterioration of the toner further progresses, some toner particles come to be charged oppositely to the normally-charged toner (hereinafter, referred to as "oppositely-charged toner"). Once the oppositely-charged toner separates from the developing roller 340, it receives the force in an opposite direction to the normally-charged toner. Specifically, the toner receives the force to move from the photoconductor 310 toward the developing roller 340 by the developing voltage Vmin and receives the force to move from the developing roller 340 toward the photoconductor 310 by the collecting voltage Vmax. Accordingly, the oppositely-charged toner will fly in the opposite direction to the normally-charged toner.

The oppositely-charged toner tends to adhere to the background area rather than to the image area and hence cause image fogging. Once the oppositely-charged toner adheres to the photoconductor 310, the toner is not easily caused to fly again from the photoconductor 310 toward the developing roller 340 by the developing voltage Vmin. This is because the oppositely-charged toner only has a small absolute value of the charge quantity and thus receives only a small force from an electric field. Thus, the toner is unlikely to fly. According to the method in Patent Literature 1, it is therefore impossible to prevent the oppositely-charged toner from adhering to the background area of the electrostatic latent image.

Solution to Problem

The present invention has a purpose to provide an image forming apparatus and an image forming method capable of preventing a low-charged toner and an oppositely-charged toner from adhering to a background area of an electrostatic latent image on a photoconductor, thereby restraining the occurrence of image fogging of the background area on a printed material.

To achieve the above purpose, the present invention provides an image forming apparatus of non-contact developing type comprising an image carrier, a developing roller for giving non-magnetic mono-component toner to the image carrier, and a voltage application section for applying a developing bias between the image carrier and the developing roller, wherein the voltage application section applies, as the developing bias, a developing voltage Vmin for forming an electric field in a direction that causes the toner to fly from the developing roller to the image carrier, and a collecting voltage Vmax for forming an electric field in a direction that causes the toner to fly from the image carrier to the developing roller so that the developing voltage and the collecting voltage are alternately repeatedly applied, and the voltage application section sets the developing voltage Vmin to a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier.

According to another aspect, the present invention provides an image forming method of a non-contact developing type using an image carrier and a developing roller for giving non-magnetic mono-component toner to the image carrier, the method being performed by applying a developing bias between the image carrier and the developing roller to form a visible toner image on the latent image on the image carrier, wherein the developing bias is applied by alternately repeating: application of a developing voltage Vmin for forming an electric field in a direction that causes the toner to fly from the developing roller to the image carrier, and application of a collecting voltage Vmax for forming an electric field in a direction that causes the toner to fly from the image carrier to the developing roller, the developing voltage Vmin is set to a value at which an electric field intensity in an image area of an electrostatic latent image on the image carrier is sufficient to cause the toner to fly from the developing roller to the image carrier and an electric field intensity in a background area of the electrostatic latent image on the image carrier is insufficient to cause the toner to fly from the developing roller to the image carrier.

According to the image forming apparatus and method of the present invention, electric field intensity can be formed to cause the toner to fly from the developing roller to the image carrier in the image area but not cause the toner to fly in the background area. This makes it possible to prevent the toner from adhering to the background area and thereby restrain the occurrence of image fogging. In the following description, the term "image area" also includes a clearance between the developing roller and (a surface of) the image carrier (a photoconductor) corresponding to the image area of the electrostatic latent image and the term "background area" also includes a clearance between the developing roller and (a surface of) the image carrier (the photoconductor) corresponding to the background area of the electrostatic latent image.

Advantageous Effects of Invention

The present invention can provide an image forming apparatus and method capable of preventing low-charged toner and oppositely-charged toner from adhering to a background area of an electrostatic latent image on a photoconductor and thus restraining occurrence of fogging of the background area on a printed material.

DESCRIPTION OF EMBODIMENTS

A detailed description of a preferred embodiment of the present invention will now be given referring to the accompanying drawings.

<First Embodiment>

In this embodiment, the present invention is exemplified as an image forming apparatus of a non-contact developing type.

<Apparatus Configuration>

Figure 4:
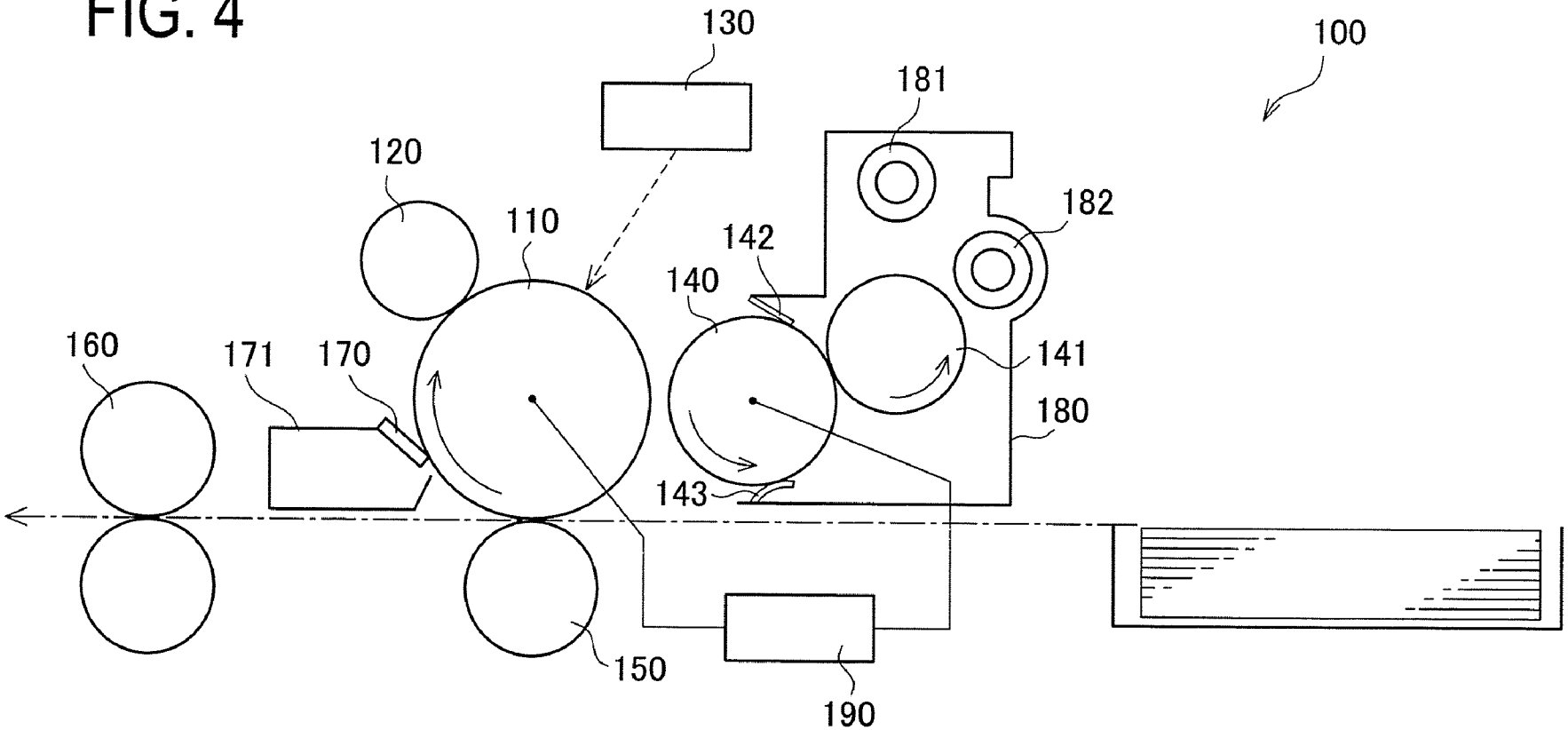
FIG. 4 is a view to explain an image forming apparatus of a first embodiment.

A mechanical configuration of an image forming apparatus of this embodiment is explained with reference to FIG. 4. An image forming apparatus 100 includes a photoconductor 110, a charging device 120, an exposure device 130, a developing roller 140, a supply roller 141, a restriction blade 142, a neutralization sheet 143, a transfer unit 150, a fuser unit 160, a cleaner 170, a toner collecting container 171, a buffer 180, an upstream screw 181, a downstream screw 182, and a voltage application section 190.

The photoconductor 110 is an image carrier of a cylindrical shape having a surface on which an electrostatic latent image is to be formed. The charging device 120 is used to uniformly charge the surface of the photoconductor 110. The exposure device 130 is used to apply light to the uniformly charged surface of the photoconductor 110 to form an electrostatic latent image thereon. The developing roller 140 is used to give toner to the electrostatic latent image on the photoconductor 110.

The image forming apparatus 100 of this embodiment performs development in a non-contact developing manner in which the photoconductor 110 and the developing roller 140 are placed in non-contact relation. Accordingly, the developing roller 140 is disposed to be slightly offset from the photoconductor 110 so as not to contact therewith. Furthermore, the image forming apparatus 100 is configured to apply a developing bias between the photoconductor 110 and the developing roller 140. Application and control of this developing bias is conducted by the voltage application section 190.

The supply roller 141 is used to supply the toner stored in the buffer 180 to the developing roller 140 and also serves to collect undeveloped toner from the surface of the developing roller 140. Thus, the supply roller 141 is rotated in an opposing direction against the rotation of the developing roller 140. The supply roller 141 is made of a foamed elastic member.

The restriction blade 142 is used to further charge the toner supplied to the developing roller 140 while controlling or metering the amount of toner to be fed. The buffer 180 is a container for storing toner. The upstream screw 181 and the downstream screw 182 are operated to circulate the toner in the buffer 180. The neutralization sheet 143 is placed to enhance a collect rate of residual toner after development.

The transfer unit 150 is used to transfer the toner on the electrostatic latent image on the surface of the photoconductor 110 to a paper. The cleaner 170 is used to collect the toner remaining on the surface of the photoconductor 110 into the toner collecting container 171 after the transfer of toner to the paper. The fuser unit 160 is used to fix the toner onto the paper to prevent the toner from coming off the paper.

A clearance between the photoconductor 110 and the developing roller 140 is about 130 μm. The toner adhering to the surface of the developing roller 140 is caused to fly across the clearance by the developing bias and finally adhere to the surface of the photoconductor 110.

<Operations of the Apparatus>

Herein, a series of operations of the image forming apparatus 100 of this embodiment is explained below. Firstly, the surface of the photoconductor 110 is uniformly charged by the charging device 120. Secondly, an electrostatic latent image is formed on the surface of the photoconductor 110 by the exposure device 130. The potential of the surface of the photoconductor 110 formed with the electrostatic latent image is different between the image area and the background area.

Then, the toner on the developing roller 140 is attracted to the electrostatic latent image on the surface of the photoconductor 110. At this development step, the toner adheres to the image area of the electrostatic latent image but does not adhere to the background area of the electrostatic latent image. This is because the developing bias is set as mentioned later. Thus, the development can be made properly without causing image fogging.

Successively, the toner is transferred from the surface of the photoconductor 110 to the paper by the transfer unit 150. An image of the toner transferred onto the paper is fixed by the fuser unit 160. This can prevent the printed toner from coming off the paper. In the above way, the printing is conducted on the paper. On the other hand, the untransferred toner remaining on the surface of the photoconductor 110 is collected by the cleaner 170.

<Cause of Image Fogging>

Figure 5:
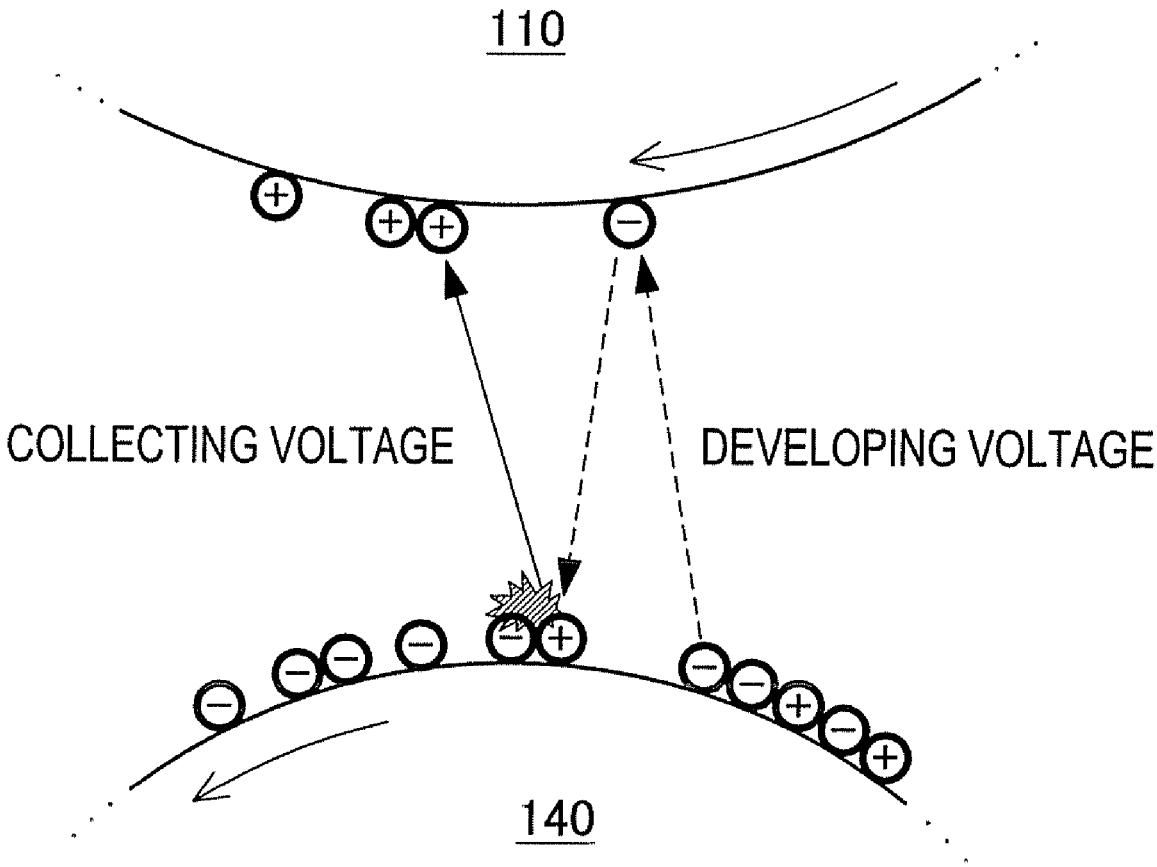
FIG. 5 is a view to explain the case where normally-charged toner flicks oppositely-charged toner by the developing bias.

Herein, a mechanism of causing image fogging is explained with reference to FIG. 5. FIG. 5 shows motion of toner particles when the developing bias is applied between the photoconductor 110 and the developing roller 140. Herein, the normally-charged toner is charged negatively and the oppositely-charged toner is charged positively.

For the image area, normally-charged toner particles fly from the surface of the developing roller 140 to the surface of the photoconductor 110 by the developing voltage Vmin. Then, at least part of the normally-charged particles fly back from the surface of the photoconductor 110 to the surface of the developing roller 140 by the collecting voltage Vmax. At that time, the returned normally-charged particles may collide with low-charged and oppositely-charged toner particles on the developing roller 140, thereby flicking the low-charged and the oppositely-charged particles off the surface of the developing roller 140.

The following explanation is given to subsequent motion of the toner particles flicked away. The motion of the low-charged particles is first explained. The flicked low-charged particle receives a force in the same direction as the normally-charged particle by the developing bias. Thus, the low-charged particle is caused to fly toward the photoconductor 110 by the developing voltage Vmin. The low-charged toner is lower in charge quantity than the normally-charged toner and hence is more likely to adhere to the background area as compared with the normally-charged toner. Once the low-charged toner adheres to the background area of the electrostatic latent image on the photoconductor 110, it could not be collected by the collecting voltage Vmax because of the low charge quantity. Furthermore, there is little possibility that the low-charged particle adhered to the background area is flicked by a normally-charged particle again. In other words, the low-charged toner once adhering to the surface of the photoconductor 110 is likely to stay thereat.

The motion of oppositely-charged particles is explained below. The returned normally-charged particle collides with oppositely-charged particles on the developing roller 140 while the collecting voltage Vmax is applied between the photoconductor 110 and the developing roller 140. The oppositely-charged particle receives the force in the opposite direction to the normally-charged toner and thus receives the force to move toward the photoconductor 110 by the electric field by the collecting voltage Vmax. Accordingly, the oppositely-charged particle flicked will directly fly toward the photoconductor 110.

The oppositely-charged toner is easy to adhere to the background area but hard to adhere to the image area because the oppositely-charged toner is charged with an opposite polarity to the normally-charged toner. On the other hand, the normally-charged toner is easy to adhere to the image area but hard to adhere to the background area. In other words, the oppositely-charged toner is more likely to adhere to the background area as compared with the normally-charged toner. Furthermore, once the oppositely-charged toner adheres to the background area of the electrostatic latent image on the photoconductor 110, it is difficult to collect the oppositely-charged toner having the low charge quantity by the developing voltage Vmin. This is because there hardly comes a normally-charged toner particle that can flick the adhering oppositely-charged toner again.

In the case where such low-charged or oppositely-charged toner adheres to the background area of the electrostatic latent image on the photoconductor 110, there is little means for removing them. Thus, such toner may cause image fogging on the paper.

To solve the defects, the developing voltage Vmin has to be adjusted to prevent the normally-charged toner from flying in the background area. Then, the normally-charged toner will be unlikely to flick the low-charged toner and the oppositely-charged toner by the collecting voltage Vmax. This makes it possible to restrain the low-charged and the oppositely-charged toner from flying in the background area. Consequently, image fogging in the background area can be prevented.

<Conditions Under Which Toner does not Fly>

Figure 6:
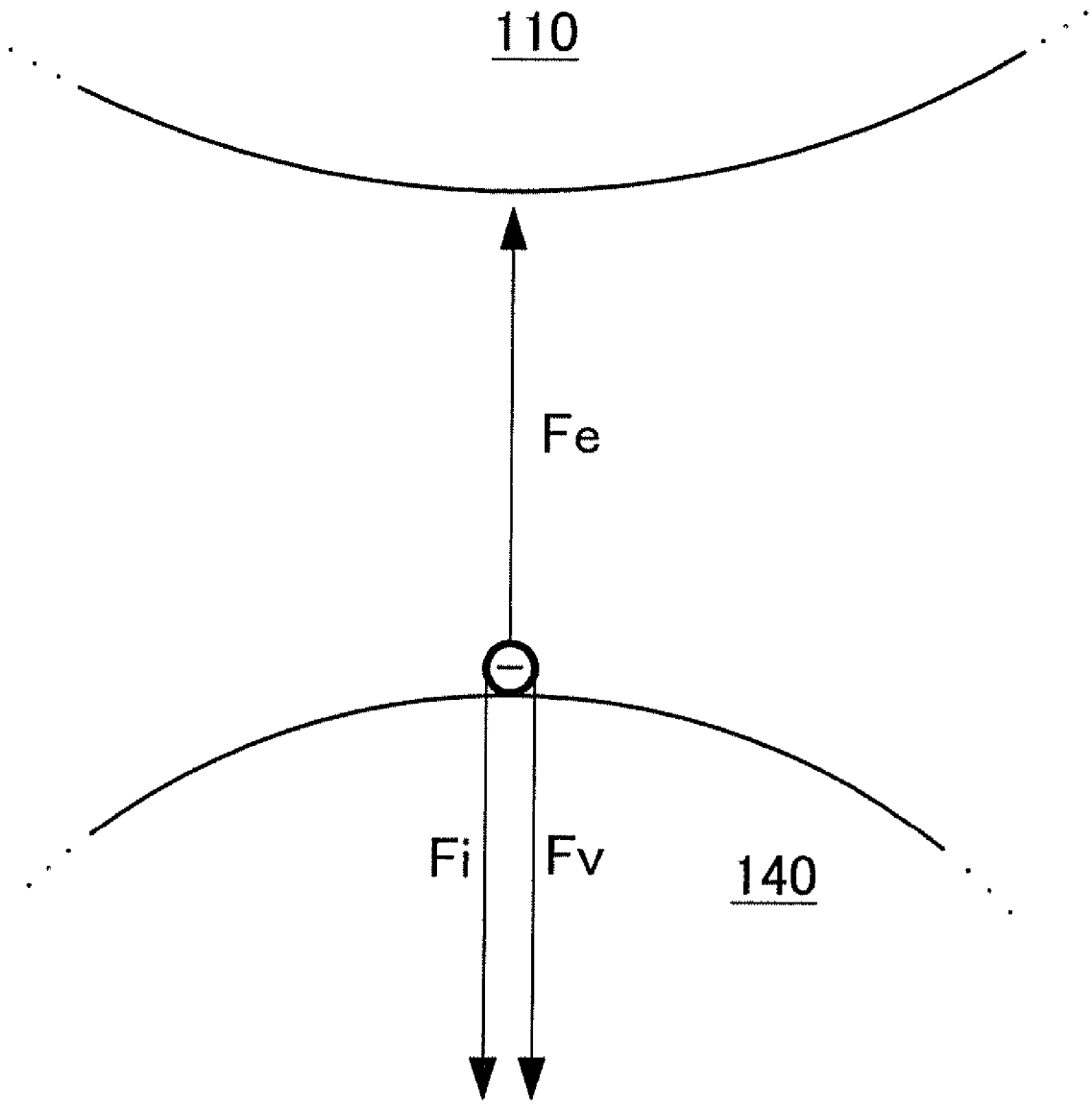
FIG. 6 is a view showing forces imparted on the toner adhered to the developing roller while a developing voltage is applied to the toner.

Herein, the conditions under which the normally-charged toner does not fly are explained below. Each force acting on toner is first explained. Each force the toner receives is explained with reference to FIG. 6. FIG. 6 shows the case where a toner particle adhering to the developing roller 140 receives an electric field induced by the developing voltage Vmin. At that time, the toner receives a coulomb force Fe from the electric field generated by the developing voltage Vmin (hereinafter, simply referred to as "coulomb force"). Furthermore, the toner receives an image force Fi from the developing roller 140 and also receives a mechanical adhesion force Fv containing Van der Waals force as a principal component from the developing roller 140 (hereinafter, simply referred to as "Van der Waals force").

The coulomb force Fe acts in a direction to move from the developing roller 140 toward the photoconductor 110. On the other hand, the image force Fi acts in an opposite direction to the coulomb force Fe. Similarly, the Van der Waals force Fv acts in an opposite direction to the coulomb force Fe. That is, the coulomb force Fe acts on the toner to separate from the developing roller 140 and the image force Fi and the Van der Waals force Fv act on the toner not to separate from the developing roller 140.

Accordingly, a resultant force F of the forces acting on the toner while the toner adhering to the developing roller 140 receives the developing voltage Vmin is represented by the following expression assuming that the direction to move from the developing roller 140 toward the photoconductor 110 is positive:

$$F=Fe-Fi-Fv$$

The toner is caused to fly in case of F>0 but not caused to fly in case of F≦0. In other words, the resultant force F is a separation force whereby to determine whether or not the toner separates from the developing roller 140 (hereinafter, referred to as a "separation force F"). It is to be noted that gravity is not taken into consideration.

<Each Force Acting on Toner>

Each force is explained below. The coulomb force Fe is explained first. Assuming that the charge quantity of the toner is "q", the coulomb force Fe imparted on the toner in the electric field E is represented by the following equation:

$$Fe=q\cdot E$$

That is, Fe is proportional to the toner charge quantity "q".

The image force Fi is explained. Assuming the toner charge quantity is "q", the image force Fi is given by the following expression (1):

$$Fi=(\epsilon-1)\cdot q^2/\{(\epsilon+1)4\Pi\cdot\epsilon 0\cdot D^2\} \quad (1)$$

Where

"ϵ" is a relative permittivity of developing roller,

"ϵ0" is a permittivity of air, and

"D" is an average particle size.

"ϵ", "ϵ0", and "D" are known constants.

Herein, a coefficient of $q^2$ in the expression (1) is assumed to be "a". In other words, "a" is defined as the following expression:

$$a=(\epsilon-1)/\{(\epsilon+1)4\Pi\cdot\epsilon 0\cdot D^2\}$$

Thus, the image force Fi is represented by the following expression:

$$Fi=a\cdot q^2$$

where "a" is a known constant. The image force Fi is proportional to the square of the toner charge quantity "q". In the following description, the following values are used in calculation.

$$\epsilon=3$$

$$\epsilon 0=8.85\times 10^{-12}[F/m]$$

$$D=6[\mu m]$$

As the Van der Waals force Fv, an experimentally measured value is used. This measurement was performed by use of a measuring apparatus disclosed in KONICA MINOLTA TECHNOLOGY REPORT Vol. 1 (2004), page 15, "The size dependence of toner adhesion force and field detachment properties". This apparatus is arranged to measure the Van der Waals force Fv by vibrating a vibrator to provide vibration acceleration to the toner adhering to the vibrator by electrostatic force. In this measurement, the vibration acceleration is gradually increased to find the vibration acceleration at which the adhering toner separates from the vibrator. Fv can be determined from this value.

This Van der Waals force Fv substantially acts only the toner being adhering to the developing roller 140. In other words, once the toner separates from the developing roller 140, this force Fv hardly acts on the toner unless it adheres to the developing roller 140 again. It was also found from a result of the measurement that Fv does not depend on the toner charge quantity. Thus, Fv is considered to be a constant and expressed as "c" in the following description.

From the above explanation, the resultant force F imparted on the toner adhering to the developing roller 140 and receiving the developing voltage Vmin is represented by the following expression:

$$\begin{aligned} F &= Fe - Fi - Fv \\ &= -a\cdot q^2 + E\cdot q - c \end{aligned}$$

This is a quadratic function of the toner charge quantity "q". Where

ϵ>1,

ϵ0>0, and

D2>0, and hence, a>0. Therefore, F is a quadratic upward-convex function having a maximum value at a certain charge quantity "q".

Figure 7:
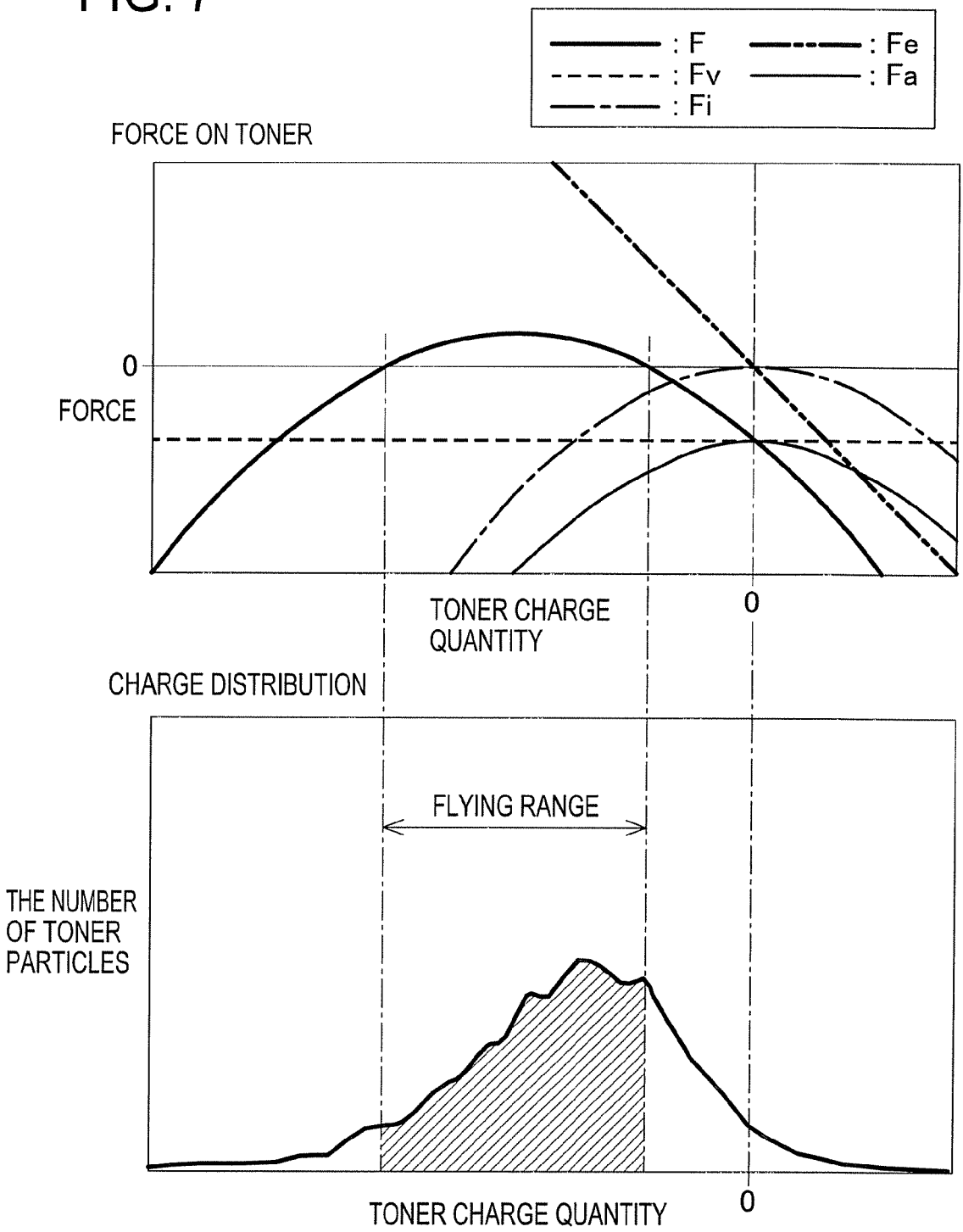
FIG. 7 is a view showing a relationship between the charge quantity of the toner adhered to the developing roller and forces imparted on the toner.

Herein, FIG. 7 shows, in an upper graph, a relationship between the toner charge quantity "q" and each force acting on the toner. The upper graph of FIG. 7 shows the separation force F, the coulomb force Fe, the image force Fi, the Van der Waals force Fv, and the adhesion force Fa. A lateral axis indicates the toner charge quantity and a vertical axis indicates the forces acting on the toner. Herein, the adhesion force Fa is a resultant of the image force Fi and the Van der Waals force Fv as defined by the following expression.

$$Fa=Fi+Fv$$

The adhesion force Fa is the force that causes toner to adhere to the developing roller 140. Using this adhesion force Fa, the separation force F is represented by the following expression.

$$\begin{aligned} F &= Fe - Fi - Fv \\ &= Fe - Fa \end{aligned}$$

As is obvious from this expression, the separation force F is positive when the coulomb force Fe exceeds the adhesion force Fa, and the toner flies.

A lower graph in FIG. 7 shows a toner charge distribution. A lateral axis indicates the toner charge quantity and a vertical axis indicates the number of toner particles having the corresponding charge quantity in the buffer 180. Toner fly in a positive range of the separation force F in the upper graph in FIG. 7. The toner included in the corresponding range (a hatched region) receive a force from the electric field generated by the developing voltage Vmin and fly from the developing roller 140 toward the photoconductor 110. In other words, the area of the hatched region is proportional to the number of flying toner particles.

The coulomb force Fe is proportional to the charge quantity "q" as mentioned above. On the other hand, the Van der Waals force Fv is a constant independent of the charge quantity "q". The image force Fi, the adhesion force Fa, and the separation force F are quadratic functions of the charge quantity "q". Since the separation force F is a quadratic function of the charge quantity "q", there is a certain charge quantity "q" at which a separation force F takes a peak value in the toner charge distribution. The toner corresponding to the maximum value of this quadratic function, namely, the toner having the charge quantity "q" corresponding to the peak separation force F is the toner most likely to fly.

Figure 8:
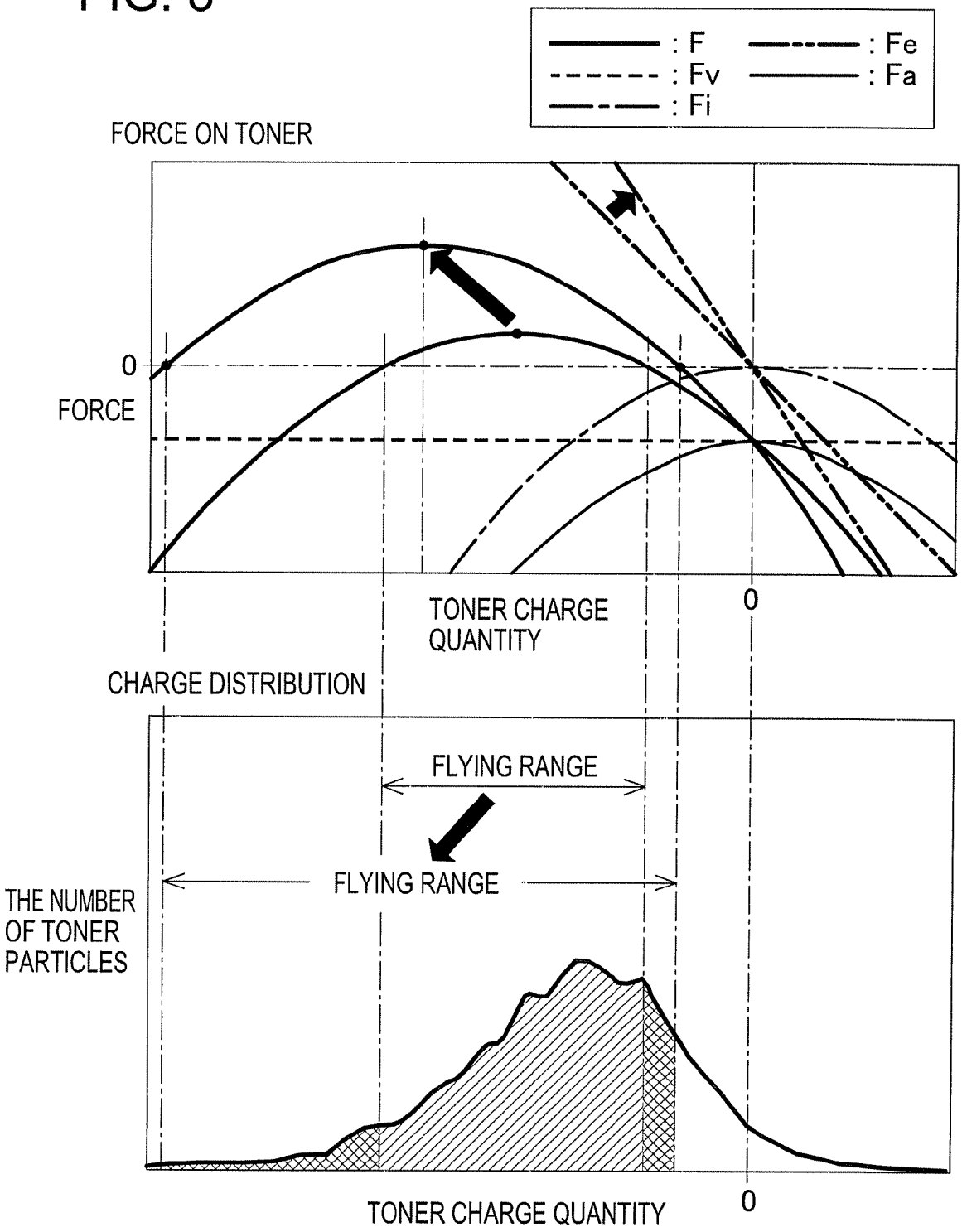
FIG. 8 is a view to explain the forces imparted on the toner and changes in the charge quantity of the flying toner in the case where an electric field is increased.

When the electric field intensity E is changed, however, the different toner from the toner easiest to fly before the change of the electric field intensity E corresponds to the toner most likely to fly, that is, the toner having the maximum separation force F. For instance, when the electric field intensity E is increased as shown in FIG. 8, the toner having a larger absolute value of the charge quantity is most likely to fly. In FIG. 8, an extreme value of the separation force F shifts obliquely. Specifically, when the electric field intensity is increased, the toner having a larger absolute value of the charge quantity corresponds to the "toner most likely to fly". This corresponds to the extreme value of the quadratic function changing with the coefficient of the linear term of the function. Furthermore, as the electric field intensity is increased, the toner flying range in the charge distribution is widened. The toner having a larger charge quantity is more likely to fly. Inversely, as the electric field intensity E is decreased, the toner having a smaller charge quantity is more likely to fly. The toner most likely to fly have the charge quantity "q" defined in the range of the charge distribution of the normally-charged toner.

As explained above, if the toner having the charge quantity "q" at which the toner is most likely to fly is not flown from the developing roller 140 toward the photoconductor 110, other toner having different charge quantities "q" also cannot be flown. Accordingly, it is only necessary to find the conditions under which the toner having the charge quantity "q" making the toner most likely to fly does not fly from the developing roller 140.

Herein, the image force Fi is the force whose intensity is determined based on the toner particle size D and the charge quantity "q". The Van der Waals force is the force determined based on environmental conditions such as humidity. That is, these are uncontrollable factors. On the other hand, the coulomb force Fe is controllable. Accordingly, setting of the electric field intensity at an appropriate value causes toner to stay adhering to the developing roller 140. In other words, it is only necessary to make the separation force F negative.

Herein, the conditions under which the toner does not fly in the background area are explained below. Setting the above electric field intensity makes the toner difficult to fly in the background area. Specifically, the condition of $F \leqq 0$ is set, thereby restraining the toner from flying. The developing voltage Vmin is therefore set to generate such electric field E for the background area to satisfy the following expression:

$$Fe=q\cdot E \leqq Fa$$

Too high voltage causes the toner to fly in the background area and, inversely, too low voltage does not cause the toner to fly in the image area, that is, development itself will not be conducted.

Herein, a boundary between a condition which causes the toner to fly and a condition which does not cause the toner to fly is determined. The boundary whether or not the toner can fly is at F=0. Accordingly, the electric field intensity Epump for F=0 is calculated by the following expression:

$$Epump=a\cdot q+c/q$$

By differentiating this by the toner charge quantity "q", the charge quantity "q" at which the toner is most likely to fly is determined. "q" is calculated as follow:

$$q=1.1\times10^{-14}[C]$$

Epump at this time is determined by substituting a value of "q":

$$Epump=2.8[MV/m]$$

Herein, a shortest distance (DS) between the photoconductor 110 and the developing roller 140 is 130 μm. Thus, an effective developing voltage |Vmin−Vb| which forms an electric field for the background area is 360V. Vb is a potential of the background area.

Figure 9:
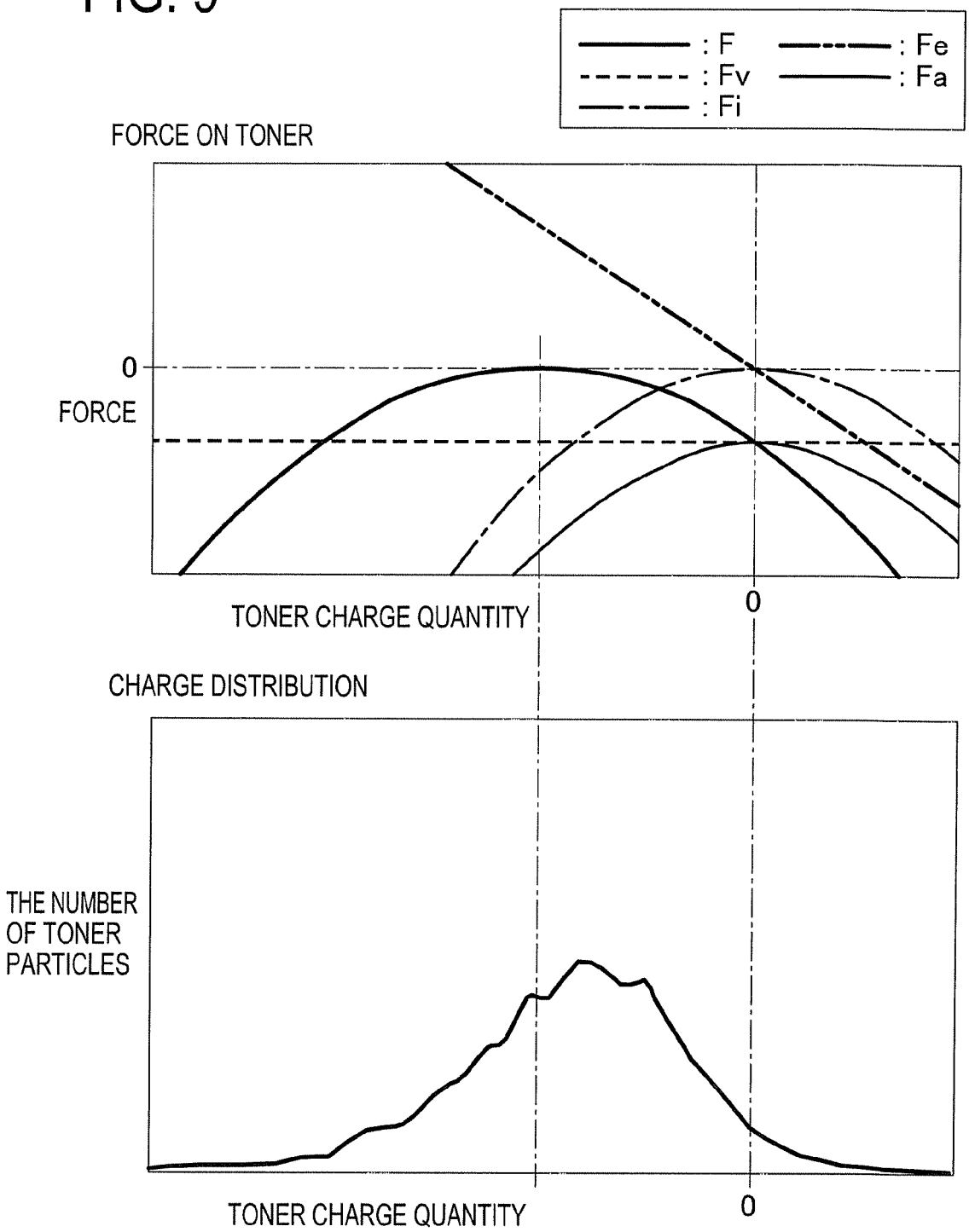
FIG. 9 is a view to explain a relationship between the critical charge quantity by which the toner adhered to the developing roller does not fly and the forces imparted on the toner.

When the effective developing voltage |Vmin−Vb| for the background area is decreased, even the toner most likely to fly is prevented from flying in the background area. In other words, as the developing voltage Vmin is decreased, the electric field intensity is weakened, thus causing the toner to stay. This state is shown in an upper graph in FIG. 9. At this electric field intensity, all the toner particles do not fly. Lower graphs in FIGS. 8 and 9 show the toner charge distribution as shown in the lower graph in FIG. 7.

<Developing Bias and Forces Imparted on Toner>

Figure 10:
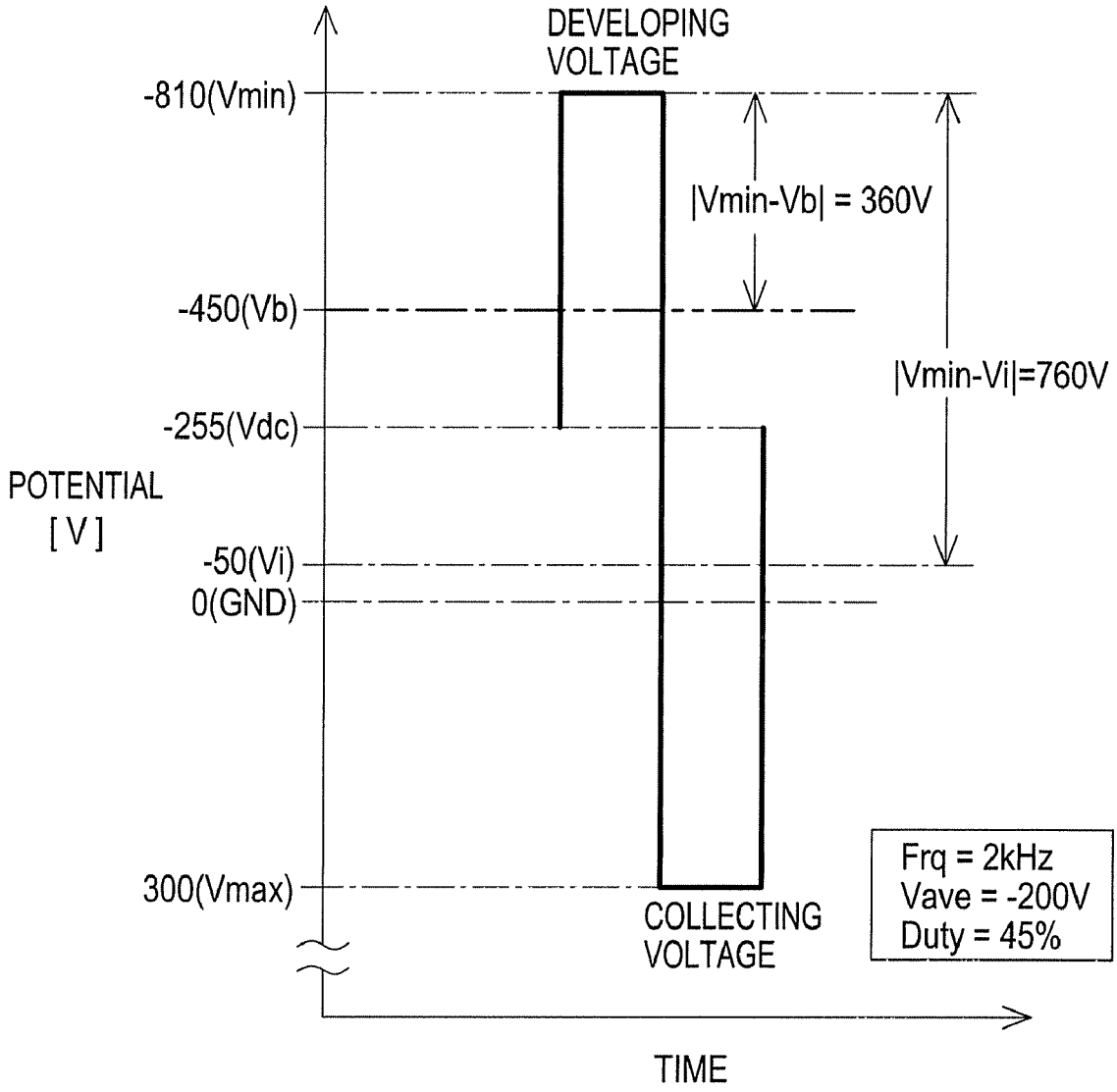
FIG. 10 is a view to explain the developing bias of the present invention.

The following explanation will be given to the developing bias to be applied by the voltage application section 190 in this embodiment. The voltage application section 190 serves not only to apply the developing bias but also to control for determining a set value of the developing bias. The developing bias in this embodiment is shown in FIG. 10, in which a lateral axis indicates the time and a vertical axis indicates the potential. In FIG. 10, Vmin denotes the developing voltage, Vmax denotes the collecting voltage, Vb denotes the potential of the background area, "Vi" denotes the potential of the image area, and Vdc denotes a direct current component of the developing bias. Frq is the frequency of developing bias, Vave is the time average of developing bias, and "Duty" is the ratio of the application time of the developing voltage Vmin to the total time. Vmin in this embodiment corresponds to Vmax in Patent Literature 1.

Herein, a relationship between the developing bias and the forces imparted on the toner will be explained about the case where the developing voltage Vmin is applied. Since the potential is different between the background area and the image area of the latent image, the potential difference between the photoconductor 110 and the developing roller 140 is different between the background area and the image area. Specifically, the effective developing voltage for the background area is |Vmin−Vb| and the effective developing voltage for the image area is |Vmin−Vi|.

The image area under application of the developing voltage Vmin is explained below. The toner receive the force in a direction to move from the developing roller 140 toward the photoconductor 110 by the electric field intensity E generated by the effective developing voltage |Vmin−Vi| for the image area. The toner on the developing roller 140 are therefore caused to fly toward the photoconductor 110. The effective developing voltage |Vmin−Vi| for the image area is 760V.

The background area under application of the developing voltage Vmin is explained below. The toner receives the force in a direction to move from the developing roller 140 toward the photoconductor 110 by the electric field intensity E generated by the effective developing voltage |Vmin−Vb| for the background area. However, the toner on the developing roller 140 does not fly toward the photoconductor 110. This is because, as shown in the upper graph in FIG. 9, the electric field intensity E generated by the effective developing voltage |Vmin−Vb| for the background area is not enough to cause the toner to fly. Herein, the effective developing voltage |Vmin−Vb| for the background area is 360V.

Figure 1:
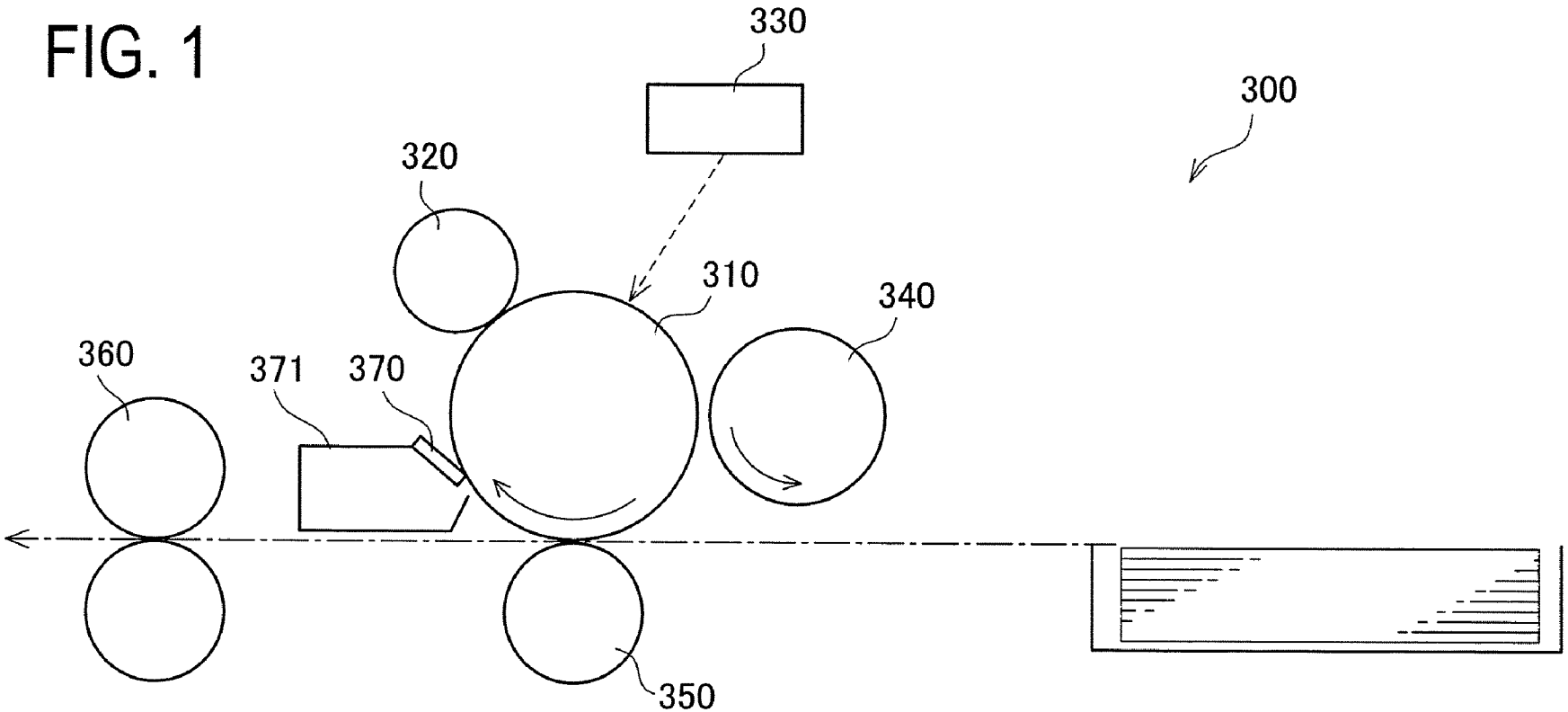
FIG. 1 is a view to explain an image forming apparatus of a non-contact developing type using non-magnetic mono-component toner.
Figure 2:
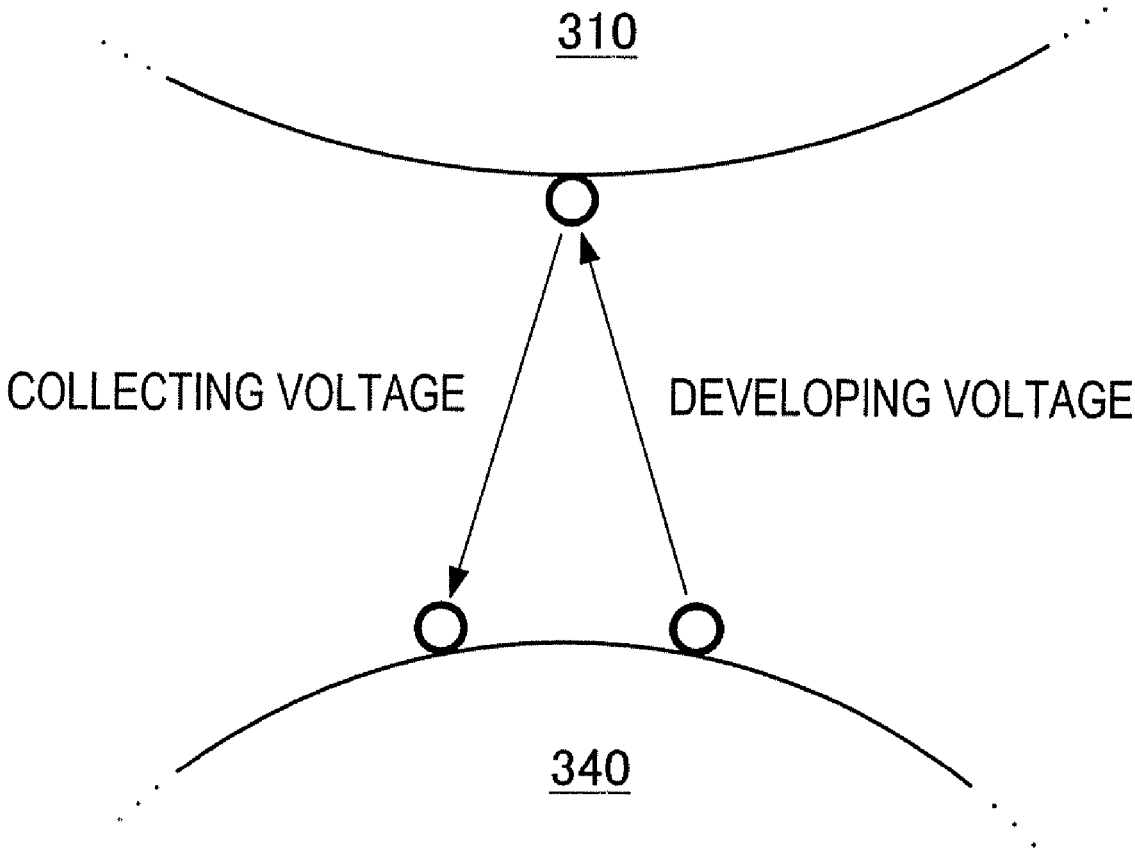
FIG. 2 is a view to explain the back-and-forth motion of toner between a photoconductor and a developing roller by a developing bias.
Figure 3:
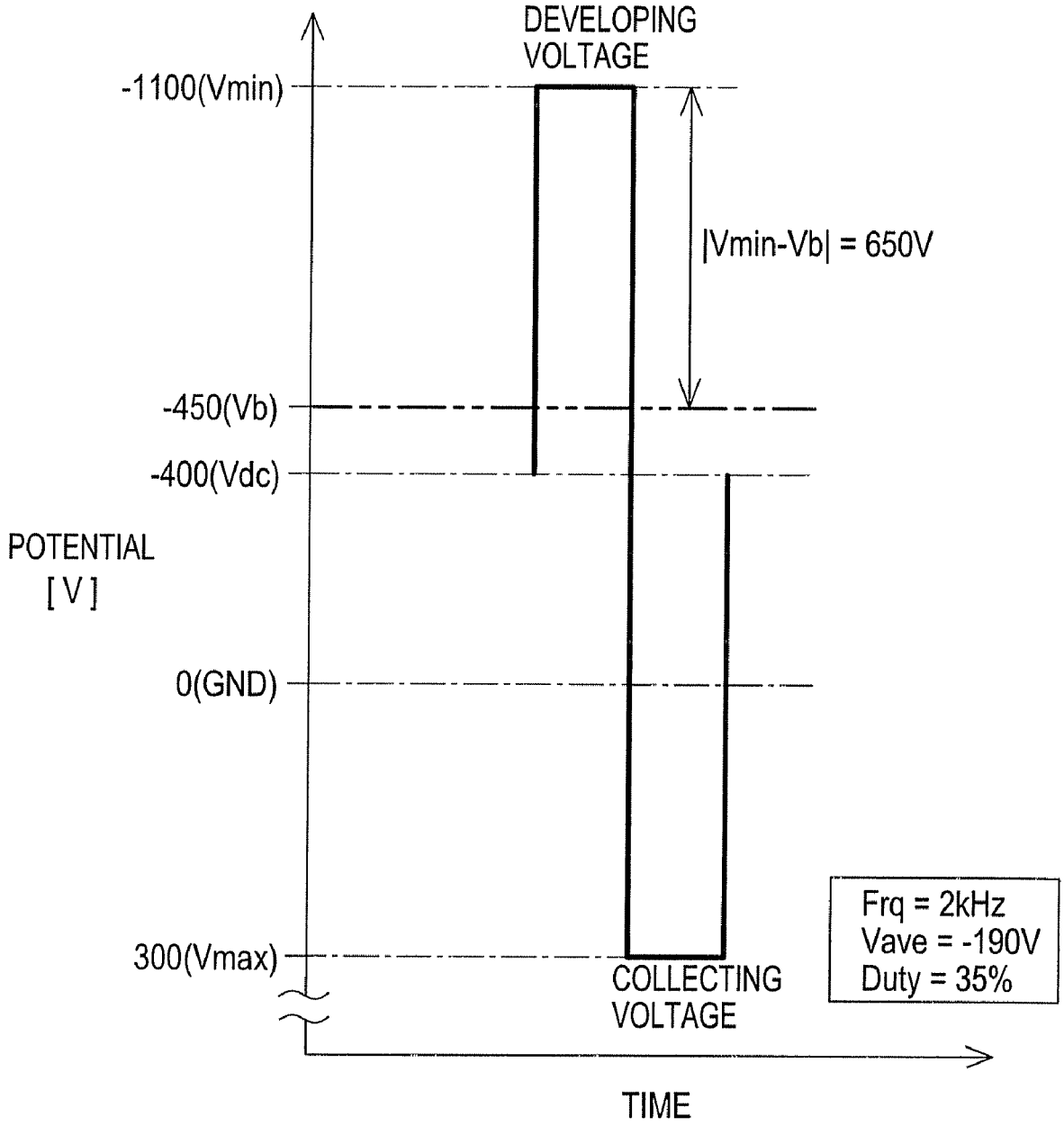
FIG. 3 is a view to explain a conventional developing bias.

The developing bias in this embodiment is smaller in absolute value of developing voltage Vmin as compared with the conventional developing bias (see FIG. 3). Other conditions are unchanged. Accordingly, the effective developing voltage |Vmin−Vb| for the background area is also reduced from 650V to 360V. The average potential is also reduced in absolute value in association with the decrease in the developing voltage Vmin.

As explained above, all of the normally-charged toner, the low-charged toner, and the oppositely-charged toner does not fly in the background area. On the other hand, the low-charged toner and the oppositely-charged toner as well as the normally-charged toner fly in the image area. At that time, the number of toner particles caused to fly is sufficient because even when the flying range is changed as shown in the lower graph in FIG. 8, the number of toner particles within the flying range does not largely change. Thus, no image fogging is caused. The density in the image area is proper.

<Test Results>

The following explanation is given to the results of the experiment conducted about the developing bias of the image forming apparatus 100 of this embodiment. This experiment was made to measure image fogging by variously changing the developing voltage Vmin. The image fogging was measured in such a manner that the toner on the photoconductor 110 was peeled by a booker tape, adhering it on a paper (Konica Minolta, J paper), and measuring C* with a color meter CR241 manufactured by Konica Minolta. Furthermore, the experiment used the cyan toner which had been used to print 500 sheets at a printing rate of 5% and hence deteriorated to some extent.

As the result of the experiment, the color ΔC* was as follows:

Present embodiment: 0.52

Conventional condition: 2.36

This result proves that the developing bias in the present embodiment could improve the color ΔC* which is a substitution for image fogging on the photoconductor 110 by about four or five times that in the conventional condition.

Figure 11:
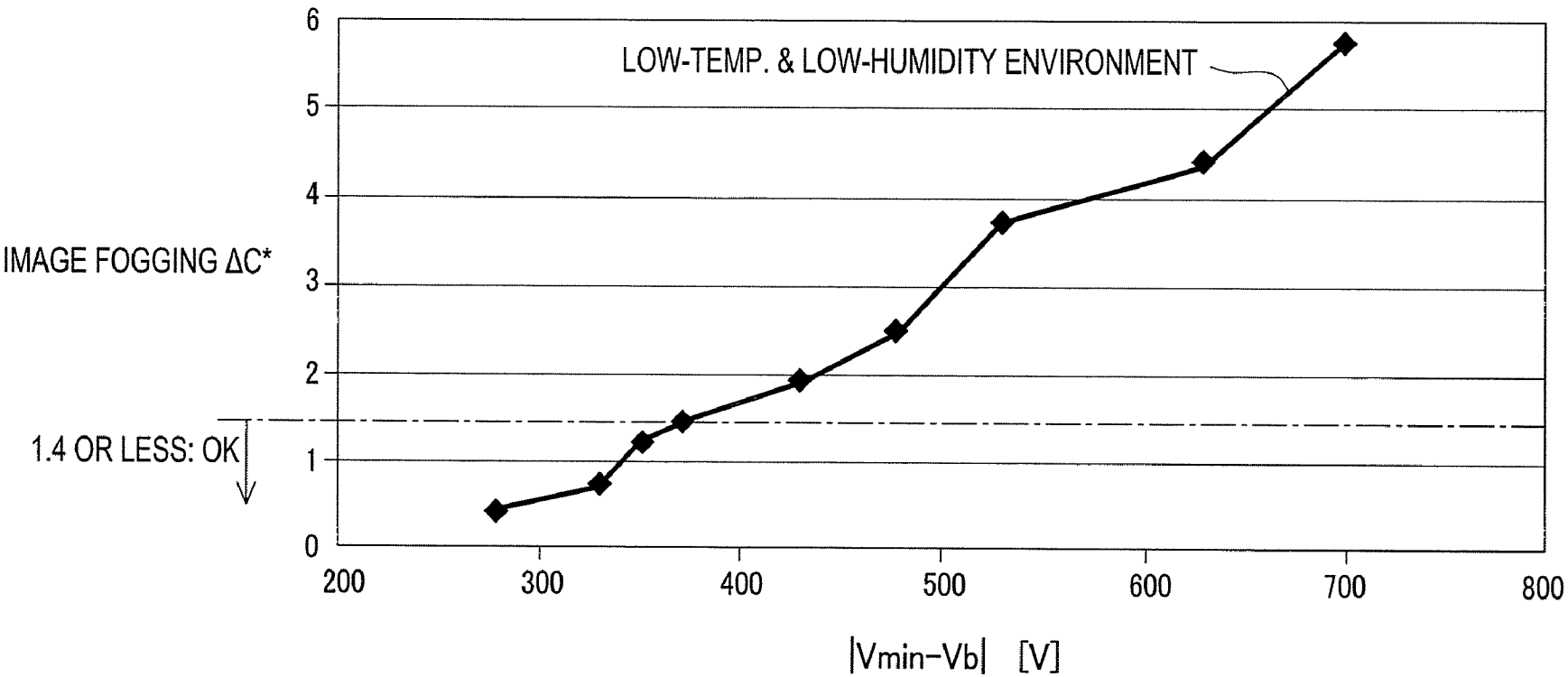
FIG. 11 is a view showing a relationship between image fogging and an absolute value of a difference between a developing voltage and a potential of the background area.

FIG. 11 shows a relationship between the developing voltage and the image fogging color ΔC*, in which a lateral axis indicates the effective developing voltage |Vmin−Vb| for the background area and a vertical axis indicates the color ΔC* which is a substitute for image fogging. Herein, a low-temperature and low-humidity environment is exemplified. In FIG. 11, as a difference between the developing voltage Vmin and the potential Vb of the background area is decreased, the color ΔC* which is a substitute for image fogging becomes smaller. This shows that image fogging is more unlikely to be generated as the effective developing voltage |Vmin−Vb| for the background area is smaller.

As explained above, the experimental results support that the image fogging in the background area could be restrained by adjusting the developing voltage Vmin to reduce the effective developing voltage |Vmin−Vb| for the background area.

<Developing Bias to be Set>

A value of the developing voltage Vmin to be set as the developing bias will be explained below. In the electric field intensity Epump just barely causing the toner to fly, F=Fe−Fa=0 and thus the following relation is established.

$$q \cdot E\mathrm{pump} = Fa$$

Accordingly, Epump is derived as below.

$$E\mathrm{pump} = Fa/q$$

The voltage Vpump forming this electric field intensity Epump is represented by the following expression:

$$V\mathrm{pump} = Fa \cdot d/q$$

where "d" is the interval between the photoconductor and the developing roller.

Therefore, in order to cause the toner to fly in the image area, the value of the developing voltage Vmin is set to make the effective developing voltage |Vmin−Vi| for the image area larger than the voltage Vpump. Simultaneously, in order not to cause the toner to fly in the background area, the value of the developing voltage Vmin is set to make the effective developing voltage |Vmin−Vb| for the background area smaller than the voltage Vpump.

Accordingly, the developing voltage Vmin is set to satisfy the following relation for the image area of the electrostatic latent image on the photoconductor 110:

$$|V\mathrm{min} - Vi| > Fa \cdot d/q$$

where

"Vi" is a potential of the image area,

"Fa" is an adhesion force acting on the toner adhering to the developing roller, "d" is the interval between the photoconductor and the developing roller, and "q" is an average charge quantity of the toner.

At this time, the toner flies in the image area.

Furthermore, the developing voltage Vmin is set to satisfy the following relation for the background area of the electrostatic latent image on the photoconductor 110:

$$|V\text{min}-Vb| \leqq Fa \cdot d/q$$

where "Vb" is a potential of the background area.

At this time, the toner does not fly in the background area. The developing voltage Vmin is set to satisfy the above two relations.

Specifically, the developing voltage Vmin has only to be set in a range defined by the following expression.

$$|V\text{min}-Vb| \leqq Fa \cdot d/q < |V\text{min}-Vi|$$

Consequently, development in the image area can be made with appropriate density and no image fogging is generated in the background area.

As explained in detail above, the image forming apparatus in the present embodiment is configured to adjust the developing voltage Vmin of the developing bias to cause the toner to fly between the developing roller 140 and the photoconductor 110 for the image area and not to cause the toner to fly therebetween for the background area. As a result, the normally-charged toner does not flick the low-charged toner and the oppositely-charged toner in the background area. It is therefore possible to prevent the low-charged toner and the oppositely-charged toner from adhering to the background area of the electrostatic latent image formed on the photoconductor 110. Thus, the image forming apparatus capable of restraining image fogging can be realized.

The present embodiment is merely an example and does not limit the present invention. The present invention therefore may be embodied in other specific forms without departing from the essential characteristics thereof. For instance, the electric field intensity may be determined by differentiating the separation force F.

The separation force F acting on the toner on the developing roller 140 while the developing voltage Vmin is applied is given by the following expression.

$$\begin{aligned} F &= Fe - Fi - Fv \\ &= -a \cdot q^2 + E \cdot q - c \end{aligned}$$

By differentiating this by the charge quantity "q", the following expression is obtained.

$$dF/dq = -2a \cdot q + E = 0$$

Hence, the separation force F at q=E/2a takes the following maximum value.

$$(E^2/4a) - c$$

That is, the force acting on the toner adhering to the developing roller 140 under the electric field intensity E is represented by the following expression.

$$F = -a(q - E/2a)^2 + (E^2/4a) - c$$

The electric field intensity E can therefore be set so as not to cause the toner to fly from the developing roller 140 ($F \leqq 0$). In other words, the toner hardly fly at the electric field intensity E at which the maximum value "$(E^2/4a)-c$" is 0. Accordingly, the developing voltage Vmin is set so that the electric field intensity E between the photoconductor 110 and the developing roller 140 satisfies the following relation:

$$(E^2/4a) - c = 0$$

$$E = \pm(4a - c)^{1/2}$$

where "a" is a known value and "c" is an experimentally determined value.

<Second Embodiment>

A second embodiment will be explained. An image forming apparatus in this embodiment has the same mechanical configuration as that in the first embodiment excepting a method of setting the developing voltage Vmin of the developing bias. In this embodiment, a permissible range is given to the developing voltage Vmin with reference to the voltage forming the electric field intensity at which the toner most likely to fly in the background area is not caused to fly.

Similar to the first embodiment, a threshold value Epump of the electric field intensity at which the toner most likely to fly is caused to fly is used as a reference. Specifically, in the same manner as in the first embodiment, when the developing voltage Vmin is set to satisfy the following relation, the toner does not or hardly fly in the background area:

$$|V\text{min}-Vb| = Fa \cdot d/q$$

where

"Vb" is a potential of the background area,

"Fa" is an adhesion force acting on the toner adhering to the developing roller, "d" is the interval between the photoconductor and the developing roller, and "q" is an average charge quantity of the toner.

At this time, similar to the first embodiment, the toner will fly in the image area.

Figure 12:
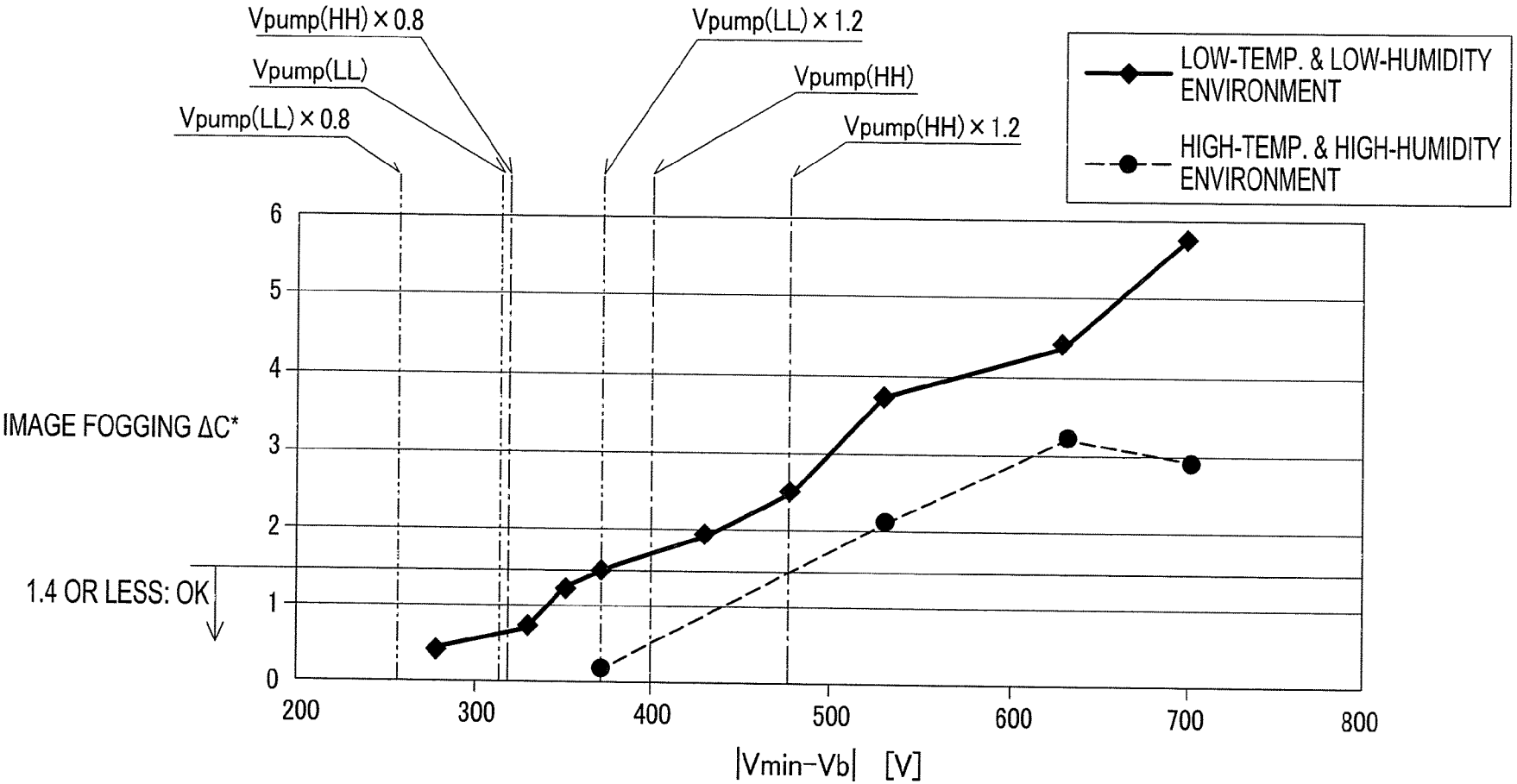
FIG. 12 is a view showing a difference depending on the environment between the image fogging and the absolute value of the difference between the developing voltage and the potential of the background area.

The image forming apparatus in this embodiment is configured to set the developing bias with reference to the aforementioned developing voltage Vmin according to the permissible range of image fogging ΔC*. FIG. 12 is a graph showing a relationship between the developing voltage Vmin and the image fogging ΔC*. This graph also shows a difference between a high-temperature and high-humidity environment and a low-temperature and low-humidity environment. The low-temperature and low-humidity environment is expressed by the same data as in FIG. 11. In both of the high-temperature and high-humidity environment and the low-temperature and low-humidity environment, the image fogging ΔC* is smaller as the value of the effective developing voltage |Vmin−Vb| for the background area is reduced. This result is not inconsistent with the mechanism of image fogging mentioned above.

When the developing voltage Vmin was set to a voltage Vpump (HH) hardly causing the toner to fly under the high-temperature and high-humidity condition, the image fogging ΔC* was about 0.5. When the developing voltage Vmin was set to a voltage Vpump (LL) hardly causing the toner to fly under the low-temperature and low-humidity condition, the image fogging ΔC* was also about 0.5. The value of image fogging ΔC* discriminable to the naked eyes is about 3. Accordingly, the above image fogging level sufficiently falls within the permissible range.

By setting the above developing voltage Vmin, little image fogging occurs in the background area. However, at the above setting, the low-charged toner and the oppositely-charged toner are not discharged from the buffer 180. In other words, the low-charged toner and the oppositely-charged toner remain stored in the buffer 180. On the other hand, since the value of the image fogging ΔC* discriminable to the naked eyes is about 3, the image fogging ΔC* is not needed to be exactly 0.5, that is, it may be set to a loose value. Accordingly, the developing voltage Vmin also may be set in a wide permissible range.

Herein, Vpump (LL) is the voltage hardly causing the toner to fly under the low-temperature and low-humidity condition. Vpump (HH) is the voltage hardly causing the toner to fly under the high-temperature and high-humidity condition. The experimental results show the followings. When the set value of the developing voltage Vmin is increased to be 1.2 times the voltage Vpump (LL) hardly causing the toner to fly under the low-temperature and low-humidity condition, the image fogging ΔC* was 1.4. When the set value of the developing voltage Vmin is increased to be 1.2 times the voltage Vump (HH) hardly causing the toner to fly under the high-temperature and high-humidity condition, the image fogging ΔC* was also 1.4. The condition that ΔC* is 1.4 or less is sufficient to ensure the quality of a printed material.

On the other hand, when the set value of the developing voltage Vmin is set to be 0.8 times the voltage Vpump (LL) hardly causing the toner to fly under the low-temperature and low-humidity condition, the image fogging ΔC* should be small even though it is not found in the experimental values. Furthermore, the same applies to the case under the high-temperature and high-humidity condition. Thus, Vmin is determined so that the effective developing voltage |Vmin−Vb| for the background area falls within the range of ±20% of Fa·d/q, where "Vb" is the potential of the background area, "Fa" is the adhesion force acting on the toner adhering to the developing roller, "d" is the interval between the image carrier and the developing roller, and "q" is the toner charge quantity.

At this time, the image fogging ΔC* is 1.4 or less. Under this condition, the toner is caused to fly in the image area.

It is to be noted that the present experiment was made to measure image fogging by variously changing the developing voltage Vmin in the same manner as in the first embodiment. Specifically, the image fogging was measured in such a manner that the toner on the photoconductor 110 was peeled by a booker tape, adhering it on a paper (Konica Minolta, J paper), and measuring C* with a color meter CR241 manufactured by Konica Minolta. Furthermore, the experiment used the cyan toner which had been used to print 2500 sheets at a printing rate of 5% and hence deteriorated to some extent.

As explained in detail above, the image forming apparatus in this embodiment is configured to adjust the developing voltage Vmin of the developing bias so as to hardly cause the toner to fly between the developing roller 140 and the photoconductor 110. Accordingly, the number of toner particles caused to fly between the developing roller 140 and the photoconductor 110 decreases. This makes it possible to prevent the normally-charged toner from flicking the oppositely-charged toner which is likely to adhere to the surface of the photoconductor 110. Consequently, the image forming apparatus capable of preventing the image fogging can be realized.

The present embodiment is merely an example and does not limit the present invention. The present invention therefore may be embodied in other specific forms without departing from the essential characteristics thereof. For instance, the permissible range of the developing voltage Vmin may be set according to a desirable value of tolerant image fogging ΔC*.

<Third Embodiment>

A third embodiment is explained below. An image forming apparatus in this embodiment has the same mechanical configuration as those in the first and second embodiments. In the image forming apparatus in this embodiment, furthermore, the developing bias is additionally adjusted with reference to the developing bias in the first embodiment or the developing bias in the second embodiment. Specifically, in this embodiment, the developing bias set in the first or second embodiment is further finely adjusted according to the interval between the photoconductor 110 and the developing roller 140.

In the first embodiment, the developing voltage Vmin is determined under the condition that the interval (DS gap) between the photoconductor 110 and the developing roller 140 is 130 μm. However, the DS gap varies by about ±10% during manufacture. On the other hand, the voltage is proportional to the DS gap (V=Ed). Even when a uniform voltage is applied, the electric field formed between the photoconductor 110 and the developing roller 140 will come under the influence of an individual difference in DS gap.

The developing voltage Vmin is therefore adjusted according to an actual DS gap. In a manufacturing process of the image forming apparatus, firstly, the DS gap is measured by e.g. a transmission type displacement sensor. If the measured DS gap is smaller than the specification, the developing voltage Vmin is set to be smaller in proportion to the deficiency. Inversely, if the DS gap is larger than the specification, the developing voltage Vmin is set to be larger in proportion to the surplus. In this way, the developing voltage can be adapted to the individual difference occurring in the manufacturing process. This value is stored as a factory default.

The DS gap may change due to wear or thermal expansion. Data on how much the DS gap changes by wear according to the number of printed sheets can be stored. It is therefore possible to previously set correction of the DS gap according to the number of printed sheets, thereby allowing re-adjustment of the developing bias. Similarly, data on the thermal expansion measured in relation to temperature can be stored in advance. Therefore, the similar method can be used.

Furthermore, the DS gap can also be measured after manufacture of the image forming apparatus. The DS gap can be determined by electric discharge between the photoconductor 110 and the developing roller 140. Herein the following Paschen's law is used:

$$V=f(\rho d)$$

where

"ρ" is gas pressure and

"d" is a distance between electrodes.

This law is to express a discharge start voltage by a function of the product of gas pressure and the distance between electrodes. Herein, the distance "d" between electrodes corresponds to the DS gap. By making this measurement at appropriate frequencies, additional fine adjustment of the developing bias can be performed. Specifically, if the DS gap is larger than a previously measured value, the developing voltage Vmin is set to be larger than a previous set value. If the DS is smaller than the previously measured value, the developing voltage Vmin is set to be smaller than the previous set value.

As explained above in detail, the image forming apparatus in this embodiment is configured to additionally adjust the developing voltage Vmin of the developing bias according to the DS gap to allow the toner to fly between the developing roller 140 and the photoconductor 110 for the image area but not to allow the toner to fly between them for the background area. Accordingly, the normally-charged toner does not flick the low-charged toner and the oppositely-charged toner in the background area. This makes it possible to prevent the low-charged toner and the oppositely-charged toner from adhering to the background area of the electrostatic latent image formed on the photoconductor 110. Consequently, the image forming apparatus capable of preventing the image fogging can be realized.

The present embodiment is merely an example and does not limit the present invention. The present invention therefore may be embodied in other specific forms without departing from the essential characteristics thereof. For instance, the DS gap may be measured with another measuring device instead of the transmission type displacement sensor. This is because the developing bias has only to be adjusted according to the measured DS.

<Fourth Embodiment>

Figure 13:
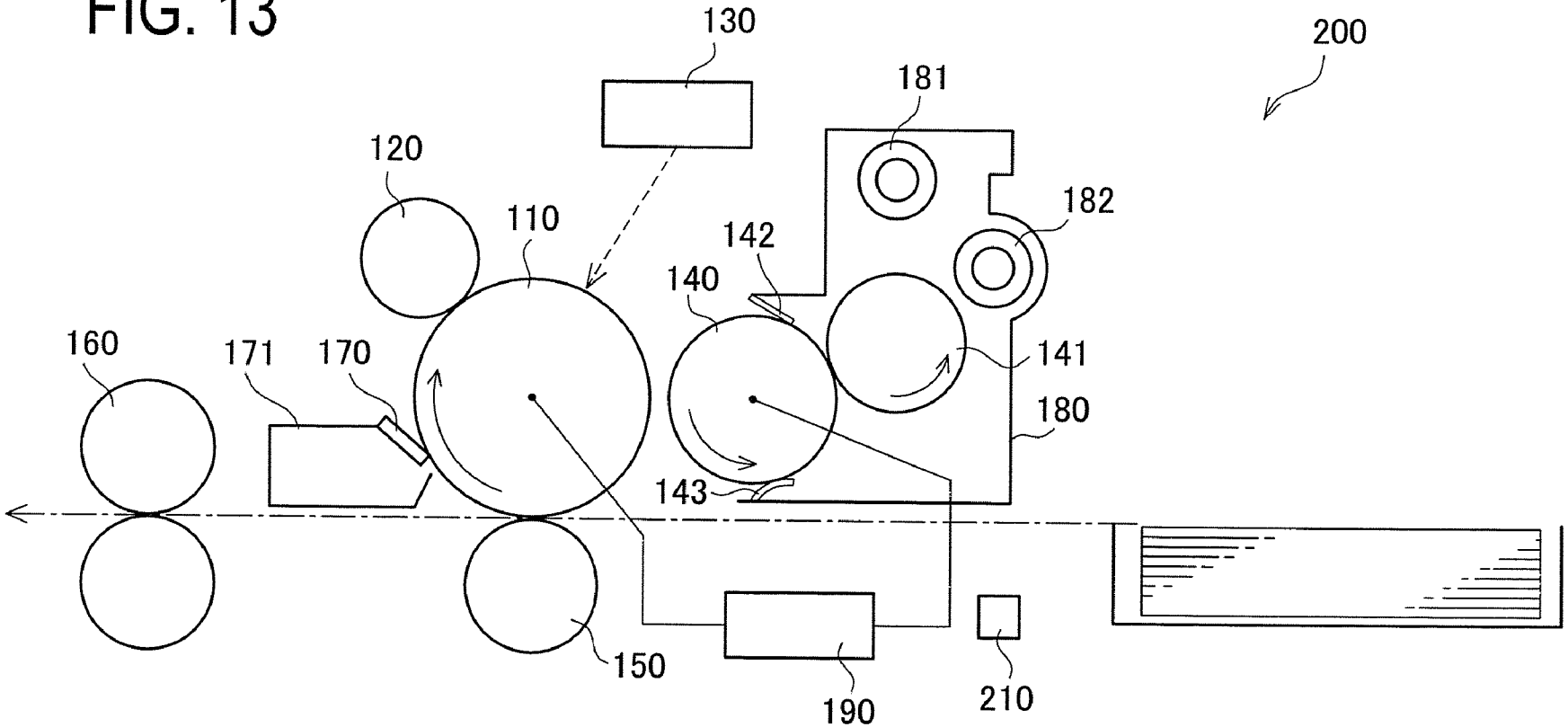
FIG. 13 is a view to explain an image forming apparatus of a fourth embodiment.

A fourth embodiment is explained below. An image forming apparatus 200 in this embodiment is shown in FIG. 13. The image forming apparatus 200 includes an environment sensor 210 in addition to the image forming apparatus 100. The environment sensor 210 is used to measure temperature or humidity. The environment sensor 210 also serves to transmit the measured temperature or humidity to the voltage application section 190. The image forming apparatus 200 in this embodiment is configured to adjust the developing voltage Vmin of the developing bias to an appropriate voltage according to a use environment.

The aforementioned Van der Waals force Fv changes with environmental changes. The Van der Waals force Fv also includes a liquid bridge force. Accordingly, the toner adhering to the developing roller 140 may become hard to separate from the developing roller 140 due to humidity, for example. This is because the level of the Van der Waals force Fv changes according to the environment.

Thus, the developing voltage Vmin of the developing bias is adjusted according to the use environment. FIG. 12 shows a relationship between the effective developing voltage |Vmin−Vb| for the background area and the color ΔC* which is a substitute for the image fogging by showing a difference between the high-temperature and high-humidity environment and the low-temperature and low-humidity environment. Under the same potential difference, the image fogging color ΔC* is larger in the low-temperature and low-humidity environment than in the high-temperature and high-humidity environment. The developing voltage Vmin is adjusted in accordance with this tendency.

In the case of using the image forming apparatus under the high-temperature and high-humidity environment, specifically, the developing voltage Vmin is increased. On the other hand, in the case of using the image forming apparatus under the low-temperature and low-humidity environment, the developing voltage Vmin is decreased. This can apply a developing bias appropriate for the use environment, thus providing a large advantage of preventing the occurrence of image fogging.

Further, the Van der Waals force Fv changes with toner deterioration. That is, the toner loses an additive agent by repeated frictional electrification and becomes hard to be charged. When the developing voltage Vmin of the developing bias is increased according to the decrease in the charge quantity, development can be made with proper density.

As explained in detail above, the image forming apparatus in this embodiment is configured to additionally adjust the developing voltage Vmin of the developing bias according to the environment, i.e., temperature or humidity, to cause the toner to fly between the developing roller 140 and the photoconductor 110 for the image area but not to cause the toner to fly therebetween for the background area. Consequently, the normally-charged toner does not flick the low-charged toner and the oppositely-charged toner in the background area. This makes it possible to prevent the low-charged toner and the oppositely-charged toner from adhering to the background area of the electrostatic latent image formed on the photoconductor 110. Consequently, the image forming apparatus capable of preventing the image fogging can be realized.

The present invention may be embodied in other specific forms without departing from the essential characteristics thereof. For instance, the developing voltage Vmin may be changed according to the toner particle size. Furthermore, the developing voltage Vmin may be adjusted according to the relative permittivity of the developing roller 140.

In the present invention, the voltage application section may set the developing voltage Vmin to satisfy the following expression for the image area of the electrostatic latent image on the image carrier:

$$|V\min - Vi| > Fa \cdot d/q$$

where

"Vi" is a potential of the image area,

"Fa" is an adhesion force acting on the toner adhering to the developing roller, "d" is the interval between the image carrier and the developing roller, and "q" is an average charge quantity of the toner, and to satisfy the following expression for the background area of the electrostatic latent image on the image carrier:

$$|V\min - Vb| \leq Fa \cdot d/q$$

where "Vb" is a potential of the background area.

In such image forming apparatus, the electric field intensity can be formed to cause the toner to fly from the developing roller to the image carrier in the image area but not to cause the toner to fly in the background area. This makes it possible to prevent the toner from adhering to the background area and restrain the occurrence of image fogging.

In the present invention, the voltage application section may set the developing voltage Vmin so that a value defined by |Vmin−Vb| for the background area of the electrostatic latent image on the image carrier falls within a range of ±20% of Fa·d/q, where "Vb" is a potential of the image area, "Fa" is an adhesion force acting on the toner adhering to the developing roller, "d" is the interval between the image carrier and the developing roller, and "q" is an average charge quantity of the toner.

In this image forming apparatus, the electric field intensity can be formed to cause the toner to fly from the developing roller to the image carrier for the image area but hardly cause the toner to fly in the background area. This makes it possible to prevent the toner from adhering to the background area and restrain the occurrence of image fogging.

In the present invention, the voltage application section may set the developing voltage Vmin according to the interval between the image carrier and the developing roller to make the potential difference defined by |Vmin−Vb| between the developing voltage Vmin and the potential Vb of the background area larger when the interval is wide, and to make the potential difference smaller when the interval is narrow.

The developing voltage Vmin is proportional to the distance between the image carrier and the developing roller and hence the electric field intensity can be adjusted to a more appropriate value.

The present invention may further comprises an environment sensor for measuring at least one of temperature and humidity, wherein the voltage application section sets the developing voltage Vmin according to a measured value of the environment sensor to make the potential difference defined by |Vmin−Vb| between the developing voltage Vmin and the potential Vb of the background area larger under a high-temperature or high-humidity condition and to make the potential difference smaller under a low-temperature or low-humidity condition.

The electric field intensity can be adjusted according to a change of the adhesion force of toner to the developing roller by environmental factor. Similarly, the electric field intensity can be formed to cause the toner to fly from the developing roller to the image carrier for the image area but not to cause the toner to fly in the background area. Consequently, the toner can be prevented from adhering to the background area and the occurrence of image fogging can be restrained.

In the present invention, the voltage application section may set the developing voltage Vmin to make the potential difference defined by |Vmin−Vb| between the developing voltage Vmin and the potential Vb of the background area larger when deterioration of the toner has progressed in comparison to the case the deterioration has not yet progressed.

Even if the charge quantity decreases due to toner deterioration, the electric field intensity can be formed to cause the toner to fly from the developing roller to the image carrier for the image area but not to cause the toner to fly in the background area.

REFERENCE SIGNS LIST

100, 200 Image forming apparatus
110 Photoconductor
140 Developing roller
190 Voltage application section
210 Environment sensor

The invention claimed is:

1. An image forming apparatus of non-contact developing type comprising an image carrier, a developing roller for giving non-magnetic mono-component toner to the image carrier, wherein toner particles of the toner are within a range of toner charge quantity and a voltage application section for applying a developing bias between the image carrier and the developing roller, wherein the voltage application section applies, as the developing bias, a developing voltage Vmin, which is predetermined by the image forming apparatus, for forming an electric field in a direction that causes at least a portion of the toner particles to fly from the developing roller to the image carrier, and a collecting voltage Vmax for forming an electric field in a direction that causes at least a portion of the toner particles to fly from the image carrier to the developing roller so that the developing voltage and the collecting voltage are alternately repeatedly applied, and the voltage application section sets the developing voltage Vmin so that a value defined by |Vmin−Vb| for the background area of an electrostatic latent image on the image carrier falls within a range of ±20% of Fa·d/q, where "Vb" is a potential of the background area, "Fa" is an adhesion force acting on the toner adhering to the developing roller, "d" is the interval between the image carrier and the developing roller, and "q" is an average charge quantity of the toner, so that an electric field intensity in an image area of an electrostatic latent image on the image carrier is sufficient to cause toner particles of the toner within a flying range of the range of the toner charge quantity to fly from the developing roller to the image area of the electrostatic latent image on the image carrier and an electric field intensity in a background area of the electrostatic latent image on the image carrier is insufficient to cause, thereby preventing, toner particles that are on the developing roller and within the range of the toner charge quantity to fly from the developing roller to the background area of the electrostatic latent image on the image carrier.

2. The image forming apparatus according to claim 1, wherein the voltage application section further adjusts the developing voltage Vmin according to the interval between the image carrier and the developing roller to make the potential difference defined by

|Vmin−Vb| between the developing voltage Vmin and the potential Vb of the background area larger when the interval is wide, and to make the potential difference smaller when the interval is narrow.

3. The image forming apparatus according to claim 1 further comprising an environment sensor for measuring at least one of temperature and humidity, wherein the voltage application section further adjusts the developing voltage Vmin according to a measured value of the environment sensor to make the potential difference defined by

|Vmin−Vb| between the developing voltage Vmin and the potential Vb of the background area larger under a high-temperature or high-humidity condition and to make the potential difference smaller under a low-temperature or low-humidity condition.

4. The image forming apparatus according to claim 1, wherein the voltage application section further adjusts the developing voltage Vmin to make the potential difference defined by |Vmin−Vb| between the developing voltage Vmin and the potential Vb of the background area larger when deterioration of the toner has progressed in comparison to the case the deterioration has not yet progressed.

5. An image forming method of a non-contact developing type using an image carrier and a developing roller, of an image forming apparatus, for giving non-magnetic mono-component toner to the image carrier, wherein toner particles of the toner are within a range of toner charge quantity, the method being performed by applying a developing bias between the image carrier and the developing roller to form a visible toner image on the latent image on the image carrier, wherein applying the developing bias by alternately repeating:

application of a developing voltage Vmin, which is predetermined by the image forming apparatus, for forming an electric field in a direction that causes at least a portion of the toner particles to fly from the developing roller to the image carrier, and application of a collecting voltage Vmax for forming an electric field in a direction that causes at least a portion of the toner to fly from the image carrier to the developing roller, adjusting the developing voltage Vmin so that a value defined by |Vmin−Vb| for the background area of an electrostatic latent image on the image carrier falls within a range of ±20% of Fa·d/q, where "Vb" is a potential of the background area, "Fa" is an adhesion force acting on the toner adhering to the developing roller, "d" is the interval between the image carrier and the developing roller, and "q" is an average charge quantity of the toner, so that an electric field intensity in an image area of an electrostatic latent image on the image carrier is sufficient to cause toner particles of the toner within a flying range of the range of the toner charge quantity to fly from the developing roller to the image area of the electrostatic latent image carrier and an electric field intensity in a background area of the electrostatic latent image on the image carrier is insufficient to cause, thereby preventing, toner particles that are on the developing roller and within the range of the toner charge quantity to fly from the developing roller to the background area of the electrostatic latent image on the image carrier.

6. The image forming method according to claim 5, wherein the developing voltage Vmin is further adjusted according to the interval between the image carrier and the developing roller to make the potential difference expressed by

|Vmin−Vb| between the developing voltage Vmin and the potential Vb of the background area larger when the interval is wide and to make the potential difference smaller when the interval is narrow.

7. The image forming method according to claim 5, further comprising the step of measuring at least one of temperature and humidity, wherein the developing voltage Vmin is is further adjusted according to a measured value of the environment sensor to make the potential difference defined by

|Vmin−Vb| between the developing voltage Vmin and the potential Vb of the background area larger under a high-temperature or high-humidity condition and to make the potential difference smaller under a low-temperature or low-humidity condition.

8. The image forming method according to claim 5, wherein the developing voltage Vmin is further adjusted to make the potential difference defined by |Vmin−Vb| between the developing voltage Vmin and the potential Vb of the background area larger when deterioration of the toner has progressed in comparison to the case the deterioration has not yet progressed.

* * * * *